US005181727A

United States Patent [19]

Fukumura

[11] Patent Number: 5,181,727

[45] Date of Patent: Jan. 26, 1993

[54] TOY GAME APPARATUS WITH VERTICALLY EXTENDABLE APPENDAGE

[75] Inventor: Satoshi Fukumura, Tokyo, Japan

[73] Assignee: Sente Creations Co., Ltd., Tokyo, Japan

[21] Appl. No.: 761,275

[22] Filed: Sep. 17, 1991

[30] Foreign Application Priority Data

Sep. 17, 1990 [JP] Japan ..... 2-254408

[51] Int. Cl.[5] ..... A63F 9/00; A63H 3/36

[52] U.S. Cl. ..... 273/450; 446/320; 446/487; 446/490

[58] Field of Search ..... 273/449, 450; 446/320, 446/390, 325, 396, 368, 487, 489, 490, 330; 33/755, 771

[56] References Cited

U.S. PATENT DOCUMENTS

| | | | |
|---|---|---|---|
| 2,669,063 | 2/1954 | Lang | 446/320 |
| 4,574,486 | 3/1986 | Drechsler | 33/755 X |
| 4,932,655 | 6/1990 | Kurita | 273/450 |

*Primary Examiner*—Mickey Yu
*Attorney, Agent, or Firm*—Salter, Michaelson & Benson

[57] ABSTRACT

A toy game apparatus includes a body portion, a vertically extendable semi-rigid appendage, and an advancing mechanism in the body portion for advancing the appendage from a retracted position therein to various vertically upwardly extended positions relative thereto. The body portion is preferably formed in the configuration of a waiter character figure, and the appendage is preferably formed as an arm on the waiter character figure which is vertically extendable for supporting a tray and dishes at various elevations.

14 Claims, 6 Drawing Sheets

TOY GAME APPARATUS WITH VERTICALLY EXTENDABLE APPENDAGE

BACKGROUND AND SUMMARY OF THE INVENTION

The instant invention relates to amusement games and more particularly to a toy game apparatus which includes a vertically extendable appendage.

It has generally been found that games which incorporate novel and amusing game apparatus often have relatively high levels of play value. Further, it has been found that games of this type which include game apparatus comprising action character figures which are capable of amusing action movements often have even greater levels of play value. In this regard, game apparatus of this type have generally been found to be particularly effective for capturing the attention of young children, and therefore a wide variety of action game apparatus of this general type have been heretofore developed for use in games played by young children.

The instant invention provides an effective and unique game apparatus which is preferably embodied as an amusing action character figure, and which is capable of providing high levels of amusement for young children. More specifically, the instant invention provides a toy game apparatus which is preferably embodied as a waiter character figure who is capable of balancing a tray of dishes on one hand thereof. Further, the arm of the waiter character figure which is utilized for balancing dishes is vertically extendable in order to increase the elevation of a tray of dishes supported thereon above the head of the waiter character figure. Still further, the waiter character figure's arm is laterally bendable and collapsible and it is constructed so that it is vertically extendable to a point where it becomes sufficiently unstable to cause it to laterally collapse under its own weight. Accordingly, the toy game apparatus can be effectively incorporated into a game wherein various different elements are balanced on the upper extremity of the arm, and wherein the arm is gradually advanced upwardly in small increments during the course of game play until it becomes sufficiently unstable to cause it to collapse under its own weight and the weight of the elements balanced thereon.

More specifically, the game apparatus of the instant invention comprises a body portion which is adapted to be received on a substantially horizontal supporting surface, a vertically extendable semi-rigid appendage on the body portion, and manually controllable advancing means for selectively advancing the appendage upwardly from a retracted position substantially within the body portion to various different upwardly extended positions. The appendage is constructed so that it is laterally bendable and collapsible in response to a lateral bending force, and so that it is vertically extendable to a point where it becomes sufficiently unstable to cause it to collapse under its own weight. The body portion preferably comprises a human character figure, and the appendage preferably comprises a collapsible arm on the character figure which includes a flexible center core and a plurality of tubular segments on the core which are assembled so that sequential segments are normally in engagement with one another. Each of the appendage segments preferably has a reduced tubular neck formed at one end thereof and a socket formed at the opposite end thereof, and the segments are preferably assembled so that the reduced necks of the segments are assembled in the sockets of adjacent segments. The core element preferably comprises a resiliently extendable core element and it is preferably operative for resiliently biasing adjacent appendage segments into engagement with one another. The means for advancing the appendage upwardly preferably includes a substantially circular casing, and means for coiling the appendage in the casing and for dispensing the appendage therefrom in order to advance the appendage upwardly. The appendage preferably includes a platform at the upper end thereof for balancing articles thereon, and the advancing means preferably includes a spring-loaded release lever for selectively controlling the upward advancement of the appendage from the body portion. The toy game apparatus preferably further includes means for adjustably tilting the appendage so that it is advanced upwardly at a slight angle to vertical when the body portion is received on a horizontal supporting surface, and the means for tilting preferably comprises means for raising on side of the body portion above the supporting surface.

It has been found that the toy game apparatus of the instant invention can be effectively utilized in an amusing and interesting game for young children. Specifically, it has been found that when the toy game apparatus is embodied as a waiter character figure holding a tray above his head on a vertically extendable arm, the apparatus can be utilized in a game wherein various articles are balanced on the tray, and wherein the waiter's arm is advanced upwardly in small increments until it becomes so unstable that it laterally collapses under its own weight and the weight of the articles balanced thereon. It has been further found that use of the game apparatus of the subject invention in this manner can provide significant amusement for young children over prolonged periods of time.

Accordingly, it is a primary object of the instant invention to provide an effective and amusing toy game apparatus.

Another object of the instant invention is to provide a toy game apparatus wherein a semi-rigid extendable appendage is advanced upwardly from a body portion until the appendage becomes sufficiently unstable to cause it to collapse under its weight and the weight of articles placed thereon.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
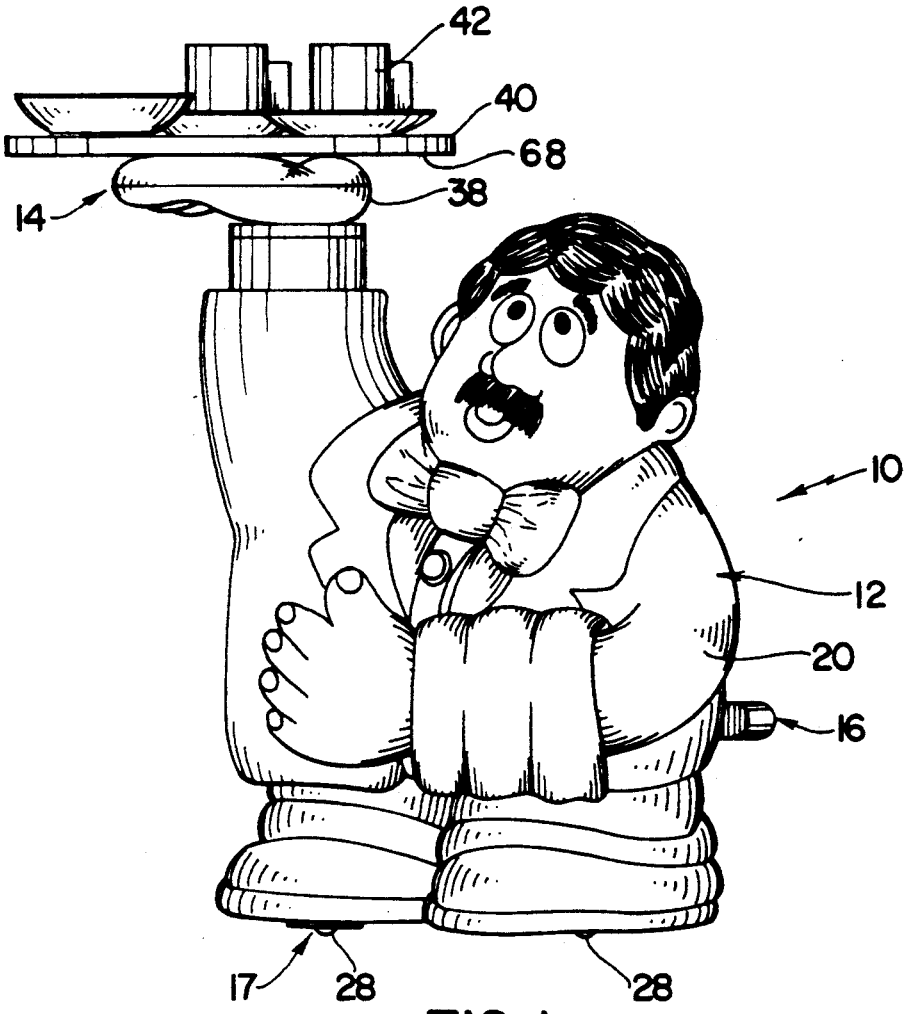
FIG. 1 is a perspective view of the toy game apparatus of the instant invention with the appendage in a retracted position.
Figure 2:
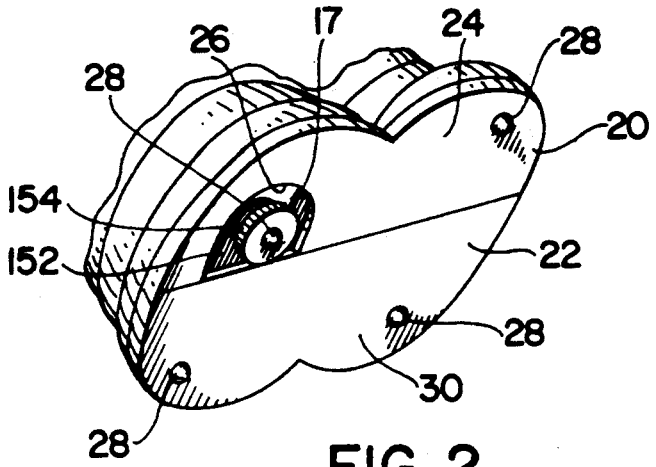
FIG. 2 is a perspective view of the bottom end portion of the game apparatus.
Figure 3:
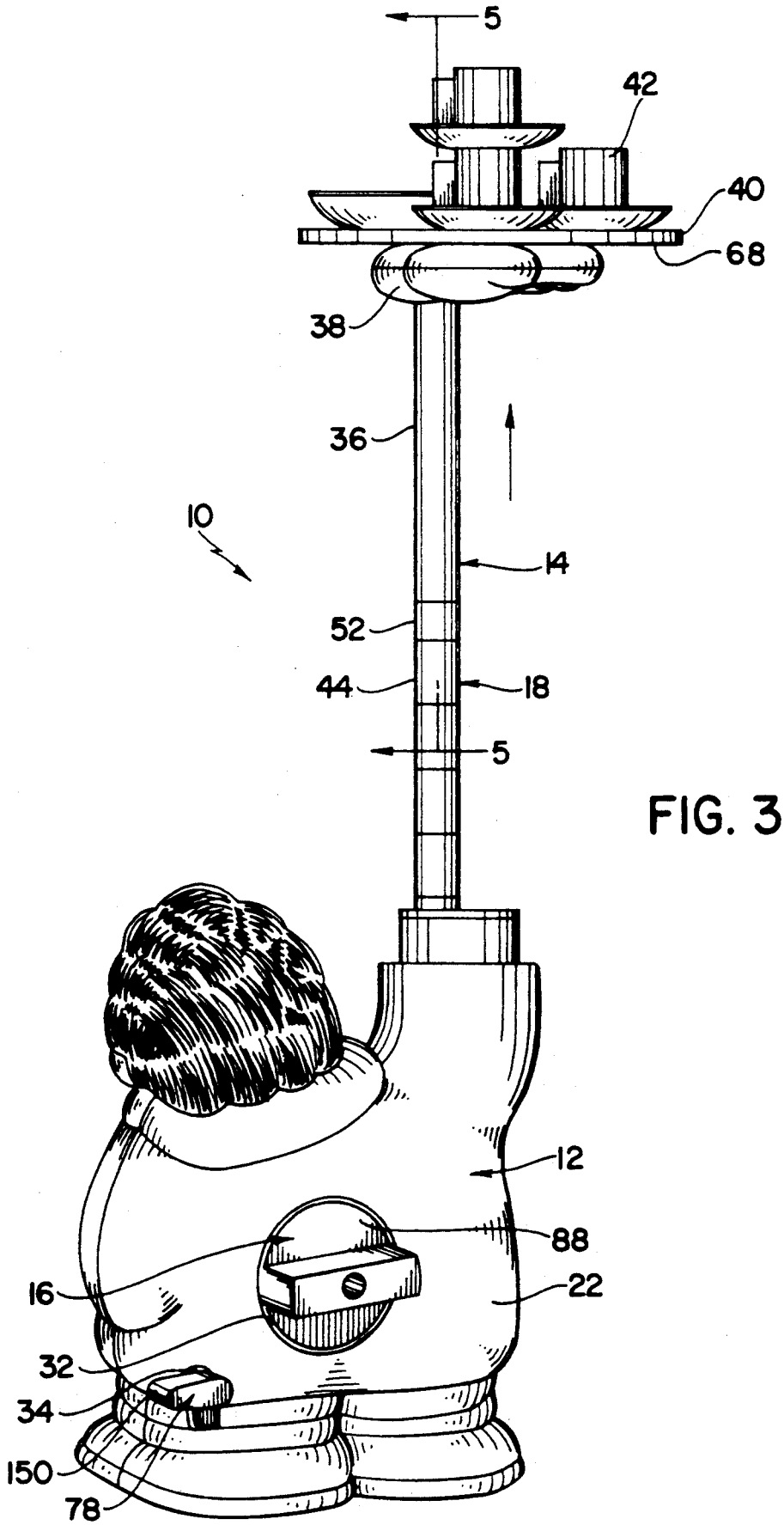
FIG. 3 is a perspective view thereof with the appendage in an upwardly extended position.

Referring now to the drawings, the game apparatus of the instant invention is illustrated in FIGS. 1 through 9 and generally indicated at 10 in FIGS. 1 and 3. The game apparatus 10 includes a body portion generally indicated at 12, an appendage generally indicated at 14, an advancing mechanism generally indicated at 16 and a tilting mechanism generally indicated at 17. The body portion 12, as herein embodied, is formed in the configuration of a waiter character figure, and the appendage 14 includes a semi-rigid extendable arm portion 18. The advancing mechanism 16 is operative for advancing the appendage 14 from the retracted position illustrated in FIG. 1, wherein the extendable arm portion 18 is contained substantially within the body portion 12, and various different upwardly extended positions, wherein the arm portion 18 is extended upwardly from the body portion 12 by different amounts. Further, the arm portion 18 is constructed so that it is vertically extendable to a point where it becomes sufficiently unstable to make it laterally collapsible under the weight of the appendage 14. Accordingly, the apparatus 10 can be effectively utilized in an amusement game, wherein game players are required to incrementally advance the appendage 14 upwardly until the arm portion 18 becomes so unstable that it collapses under the weight of the appendage 14. The tilting mechanism 17 is operable for tilting the apparatus 10 slightly, so that the appendage 14 is advanceable upwardly at a slight angle to vertical in order to selectively reduce the stability of the appendage 14.

The body portion 12 comprises front and rear body sections 20 and 22, respectively, which are preferably each integrally molded from a suitable plastic material, and which are retained in assembled relation with a plurality of screws (not shown). The front section 20 includes a base or bottom wall 24 having a notch 26 therein and a foot 28 thereon, and the rear portion 22 includes a base or bottom wall 30 having a pair of feet 28 thereon. The rear section 22 also has a centrally located circular opening 32 formed therein as well as a reduced opening 34. The front and rear portions 20 and 22, respectively, are further formed to define the base portion of an upwardly extending arm of the waiter character figure embodied in the body portion 12, and the advancing mechanism 16 is mounted in the interior of the body portion 12 so that it is operative for advancing the appendage 14 upwardly through the base portion of the arm of the waiter character figure.

The appendage 14 is illustrated most clearly in FIGS. 3 through 6, and 9, and it comprises the semi-rigid arm portion 18, a tubular wrist portion 36, a hand portion 38, a tray 40, and a plurality of dishes 42. The arm portion 18 comprises a plurality of tubular appendage segments 44, and a central core element generally indicated at 46. Each of the appendage segments 44 has a reduced neck portion 48 formed at one end thereof, and a socket 50 at the opposite end thereof, and the appendage segments are assembled in a sequential order wherein the reduced neck portions 48 of the segments 44 are received in the sockets 50 of adjacent appendage segments, with the exception of the neck portion 48 of the uppermost appendage segment 44 which is received in a tubular sleeve 52. The wrist portion 36 includes a reduced neck portion 54 at the lower end thereof which is also received in the tubular sleeve 52, and a core element 46 extends through the appendage segments 44, the sleeve 52 and the wrist portion 36. The wrist portion 36 is of substantially rigid construction and of tubular configuration and the hand 36 is integrally molded at the upper extremity of the wrist portion 36. The core element 46 comprises an elongated cord 56 and a coil spring 58 which is secured to the upper end of the cord 56 and secured to the wrist portion 36 with a pin 60. The opposite end of the cord 56 is secured to a termination tab 62 in the interior of the advancing mechanism 16 (see FIG. 9). The cord 56 is secured in the appendage 14 so that the coil spring 58 is normally maintained in a resiliently stretched or expanded disposition, and hence the cord element 56 and the spring 58 cooperate to maintain the appendage segments 44 in an assembled relation, wherein adjacent appendage segments 44 are disposed in resiliently biased engagement, and wherein the sleeve 52 is maintained in resiliently biased engagement with the uppermost appendage segment 44 and with the wrist portion 36. Accordingly, the appendage 14 is bendable for coiling the lower portion thereof in the advancing mechanism 16. Further, the appendage 14 is constructed so that it is normally maintained in a substantially straight disposition when it is extended upwardly from the body portion 12 but so that it is upwardly extendable to a point where it becomes sufficiently unstable that it becomes collapsible under its own weight.

As is hereinabove set forth, the appendage 14 also includes the tray 40, which is receivable on the hand 38, and the dishes 42. In this regard, the hand 38 is formed so that it includes a substantially horizontal upwardly facing supporting surface 64 having an upwardly extending pin 66 thereon, and the tray 40 includes a substantially flat bottom surface 68 having a central recess 70 formed therein. The tray 40 is constructed so that it is receivable on the horizontal supporting surface 64 so that the pin 66 is received in the recess 70 for maintaining the tray 40 in a predetermined location on the hand 38 as long as the supporting surface 64 is in a substantially horizontal disposition. The dishes 42 are formed to resemble various dishes which might be carried on the tray of a waiter, and they are receivable on the tray 40 so that they are supported thereon as long as the tray 40 is maintained in a substantially horizontal disposition. Accordingly, by assembling the tray 40 on the hand 38 and assembling various dishes 42 on the tray 40, the weight of the upper end of the appendage 14 can be altered to alter the overall stability of the appendage 14 as it is advanced upwardly from the body portion 12. In other words, the tendency of the appendage 14 to bend or collapse laterally can be increased both by placing additional dishes 42 on the tray 40, and by advancing the appendage 14 further upwardly with the advancing mechanism 16.

The advancing mechanism 16 is illustrated most clearly in FIGS. 6 through 9 and it includes a drive gear assembly generally indicated at 72, a mounting plate 74, a recoil assembly generally indicated at 76, an actuator assembly generally indicated at 78, and lower and upper guide tubes 80 and 82, respectively. The drive gear assembly 72 includes rear and front housing sections 84 and 86, respectively, which provide a housing for various operative components which drive the advancing mechanism 16. In this regard mounted on the rear housing section 84 is a winding gear 87 which is attached to a winding knob 88 received in the recess 32 in the rear body section 22. The winding knob 88 is connected to the winding gear 86 through a shaft 90, and the winding gear 87 intermeshes with a rotatably mounted main spring gear 92 which is integrally formed with a first intermediate gear 94. A torsion spring 96 is received and secured on the main spring gear 92, and the spring 96 is also secured to the rear and front housing sections 84 and 86, as at 98. The first intermediate gear 94 intermeshes with a rotatably mounted reduced second intermediate gear 100, which is integrally formed in coaxial relation with an enlarged third intermediate gear 102. The enlarged third intermediate gear 102 intermeshes with a reduced fourth intermediate gear 104 which is rotatably mounted on a shaft 106 and integrally formed in coaxial relation with an enlarged fifth intermediate gear 108. However, the shaft 106 is received in slots 110 in the rear and front housing sections 84 and 86, respectively, for shifting the rotatable positions of the gears 104 and 108. Accordingly, when the third intermediate gear 102 is rotated in a clockwise direction as viewed from in front of the apparatus 10 (see FIG. 7), the shaft 106 is urged against the lower ends of the slots 110 so that it is maintained in the downwardly shifted position illustrated in FIG. 7. However, when the gear 102 is rotated in a counter-clockwise direction as viewed in FIG. 7, the shaft 106 and the gears 104 and 108 are shifted upwardly as the shaft 106 is moved upwardly in the slots 110. The fifth intermediate gear 108 is positioned and constructed so that it engages a governor gear 112 on a rotatably mounted governor wheel 114 when the fifth intermediate gear 108 is in the downwardly shifted position illustrated in FIG. 7, but so that the fifth intermediate gear 108 is disengaged from the governor gear 112 when the fifth intermediate gear 108 is in the upwardly shifted position thereof. The governor wheel 114 includes a plurality of pointed peripheral governor teeth 116 and a governor element 118 comprising a pair of spaced governor teeth 120 is pivotally mounted on a shaft 122 so that the governor element 118 swings back and forth causing one or the other of the teeth 120 to engage an adjacent tooth 116 on the governor wheel 114 at any given time as the governor wheel 114 is rotated. Hence, the governor element 118 operates to retard the rate of rotation of the governor wheel 114. However, since the fifth intermediate gear 108 only engages the governor gear 112 when the gears 104 and 108 and the shaft 106 are in the downwardly shifted positions thereof, the governor wheel 114 only retards the rotation of the remaining gears in the gear assembly 72 when the gear assembly is operated in a direction corresponding to the unwinding of the spring 96. Accordingly, when the knob 88 is manipulated to wind the spring 96 in the gear assembly 72, the fifth intermediate gear 108 is disengaged from the governor gear 112 so that the governor wheel 114 and the governor element 118 are rendered inoperative, but when the gear assembly 72 is operated so that the spring 96 advances the gears of the gear assembly 72 to unwind the spring 96, the governor element 118 and the governor wheel 114 cooperate to retard the advancement of the spring 96 toward an unwound position so that the gears in the gear assembly 72 are rotated at controlled rates.

The mounting wall 74 is integrally formed with the rear housing section 84 of the gear assembly 72, and it is assembled and secured in the body portion 12 for mounting the advancing mechanism 16 therein. The mounting wall 74 has an open slot 124 formed therein which extends along one side portion thereof and behind the lower guide tube 80. The guide tubes 80 and 82 are assembled on the front side of the mounting wall 74 for guiding the appendage 14 as it is advanced outwardly from and retracted into the advancing mechanism 16, so that the arm portion 18 passes through the slot 124. The upper guide tube 82 is further operative for guiding the appendage 14 so that it is advanced substantially vertically upwardly as it is moved to various upwardly extended positions by the advancing mechanism 16.

Figure 9:
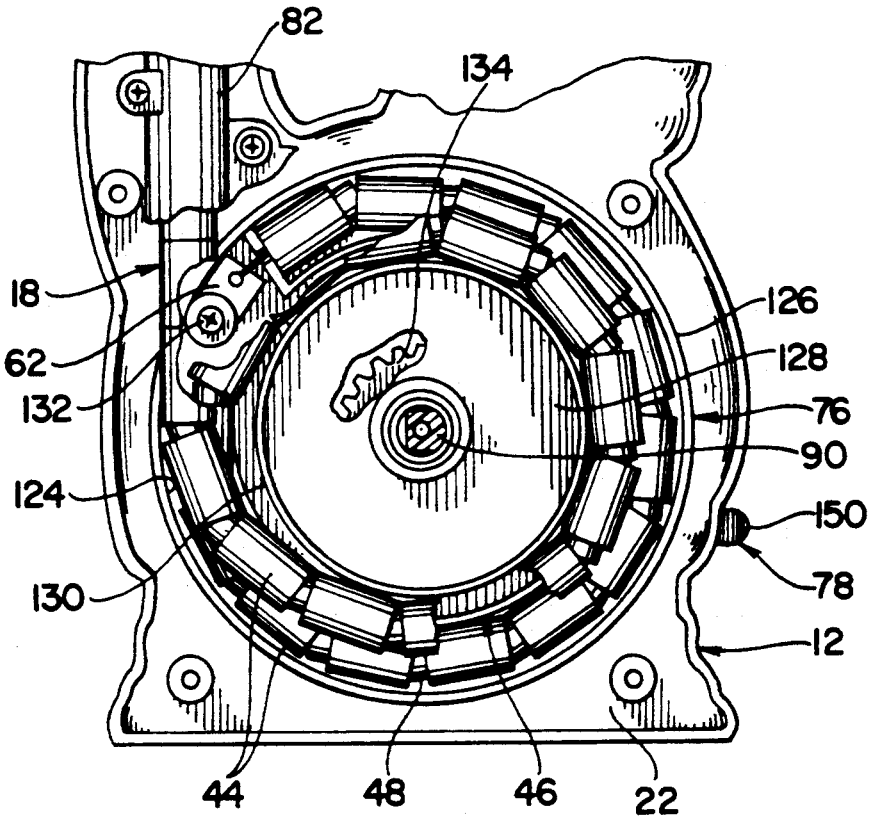
FIG. 9 is a front elevational view of the advancing mechanism with the gear assembly and portions of the support wall thereof removed.

The casing 76 is of substantially circular configuration and it includes a substantially circular peripheral wall 126, and a rear wall 128. The casing 76 is mounted on the shaft 90 so that it rotates therewith behind the mounting wall 74. The front side of the casing 76 is open and it faces the mounting wall 74, so that the interior of the casing 76 communicates with the slot 124. The casing 76 further includes a substantially circular inner partition 130 which is spaced inwardly from the peripheral wall 126 in substantially concentric relation therewith so that the walls 126, 128, and 130 cooperate with the mounting wall 74 to define a generally donut-shaped cavity for receiving the arm portion 18 in a coiled disposition therein. As illustrated in FIG. 9, the end tab 62 is secured in the interior of the donut-shaped cavity in the casing section 76 by means of a screw 132 and the appendage 14 is assembled with the advancing mechanism 16 so that the arm portion 18 extends through the guide tubes 80 and 82 and the slot 124, and into the donut-shaped cavity in the casing 76. Accordingly, as the winding knob 88 is rotated to retract the appendage 14 into the body portion 12, the arm portion 18 is coiled in the interior of the casing 76 as the casing 76 is rotated in a counter clockwise direction as viewed from in front of the apparatus 10 (see FIG. 9). Further, when the casing 76 is rotated by the spring 76 in a clockwise direction as viewed from in front of the apparatus 10, the appendage 14 is advanced outwardly from the casing 76 and upwardly through the guide tubes 80 and 82 so that it is advanced substantially vertically upwardly from the body portion 12.

Figure 8:
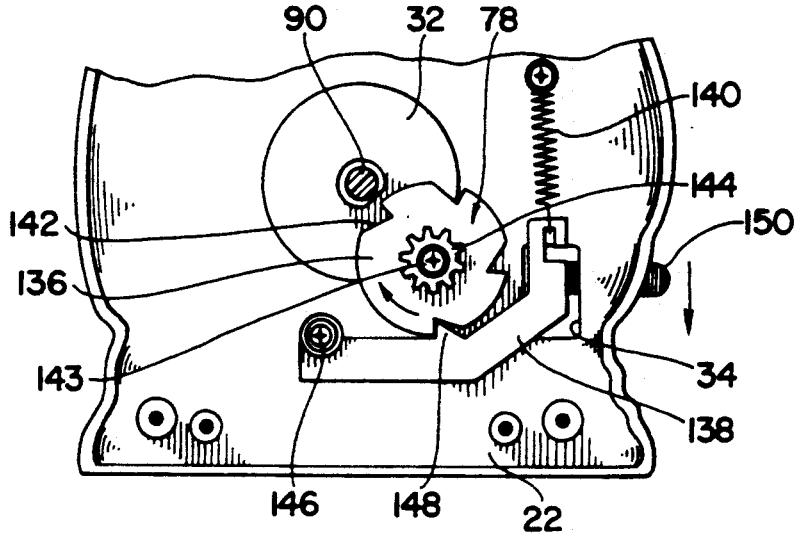
FIG. 8 is a front elevational view of the rearmost portions of the advancing mechanism.

The actuator assembly 78 is illustrated most clearly in FIGS. 3 and 8, and it is mounted in the rear section 22 of the body portion 12. The actuator assembly 78 comprises a gear ring 134 which is integrally formed on the rear side of the rear wall 128 of the casing 76, an actuator wheel 136, an actuator member 138, and an actuator spring 140. The actuator wheel 136 has a plurality of spaced peripheral notches 142 formed therein and it is rotatably mounted in the interior of the rear body section 22 with a screw 143. Integrally formed with the actuator wheel 136 is an actuator gear 144 which is received in intermeshing engagement with the gear ring 134 on the casing section 76. The actuator member 138 is pivotally mounted in the rear body portion section 22 with a screw 146 and it has a tooth 148 formed thereon which is receivable in engagement in the notches 142 on the actuator wheel 136. The actuator member 138 is biased toward the actuator wheel 136 with the spring 140 and it includes an actuator lever 150 which extends outwardly through the opening 34 in the rear body portion section 22. The lever 150 and the opening 34 are constructed so that the lever 150 is downwardly depressible against the force of the spring 140 for disengaging the tooth 148 from the actuator wheel 136. The actuator member 138 and the actuator wheel 136 are formed so that when the actuator wheel 136 is rotated in a clockwise direction as viewed from in front of the apparatus 10 (see FIG. 8) the tooth 148 is automatically cammed out of sequential notches 142, so that the actuator wheel 136 is rotatable despite the actuator member 138. However, in order to rotate the actuator Wheel 136 in a reverse direction the actuator member 138 must be depressed in order to disengage the tooth 148 from the wheel 136. Further, the gear assembly 72 is constructed so that clockwise rotation of the actuator wheel 136, as viewed from in front of the apparatus 10, corresponds to a direction wherein the torsion spring 96 is moved toward a wound position, and wherein the appendage 14 is retracted into the body portion 12. Accordingly, the actuator assembly 78 does not interfere with winding of the gear assembly 72, but it prevents movement of the gear assembly 72 toward an unwound position without disengaging the tooth 148 from the wheel 136 by depressing the lever 150. Hence, the actuator assembly 78 is manually operable for controlling the operation of the advancing mechanism 16 toward an advanced or unwound position by manipulating the lever 150. In other words, once the spring 96 has been moved to a wound position by rotating the winding knob 88, the actuator lever 150 is depressible for selectively advancing the appendage 14 to various upwardly extended positions.

The elevation mechanism 19 is illustrated most clearly in FIGS. 1 and 2, and it includes a base portion 152 which is received in the notch 26 on the bottom wall 24 of the front body portion section 20. The elevation mechanism 17 further includes an elevation member 154 which is received in threaded engagement in an opening in the base portion 152. Accordingly, the elevation member 154 is rotatable for altering the extent to which it extends downwardly from the base portion 152. The actuator member 154 has a foot 28 formed thereon, and hence, by selectively rotating the elevation member 154 relative to the base portion 152 the foot 28 can be moved downwardly or retracted upwardly in order to slightly alter the disposition of the apparatus 10 on a supporting surface. As a result, the elevation mechanism 17 is adjustable for causing the appendage 14 to be advanced upwardly at various slight angles to vertical as the appendage 14 is moved upwardly by the advancing mechanism 16. This obviously results in altering the stability of the appendage 14, and the tendency thereof to collapse as the appendage 14 is advanced upwardly.

Figure 4:
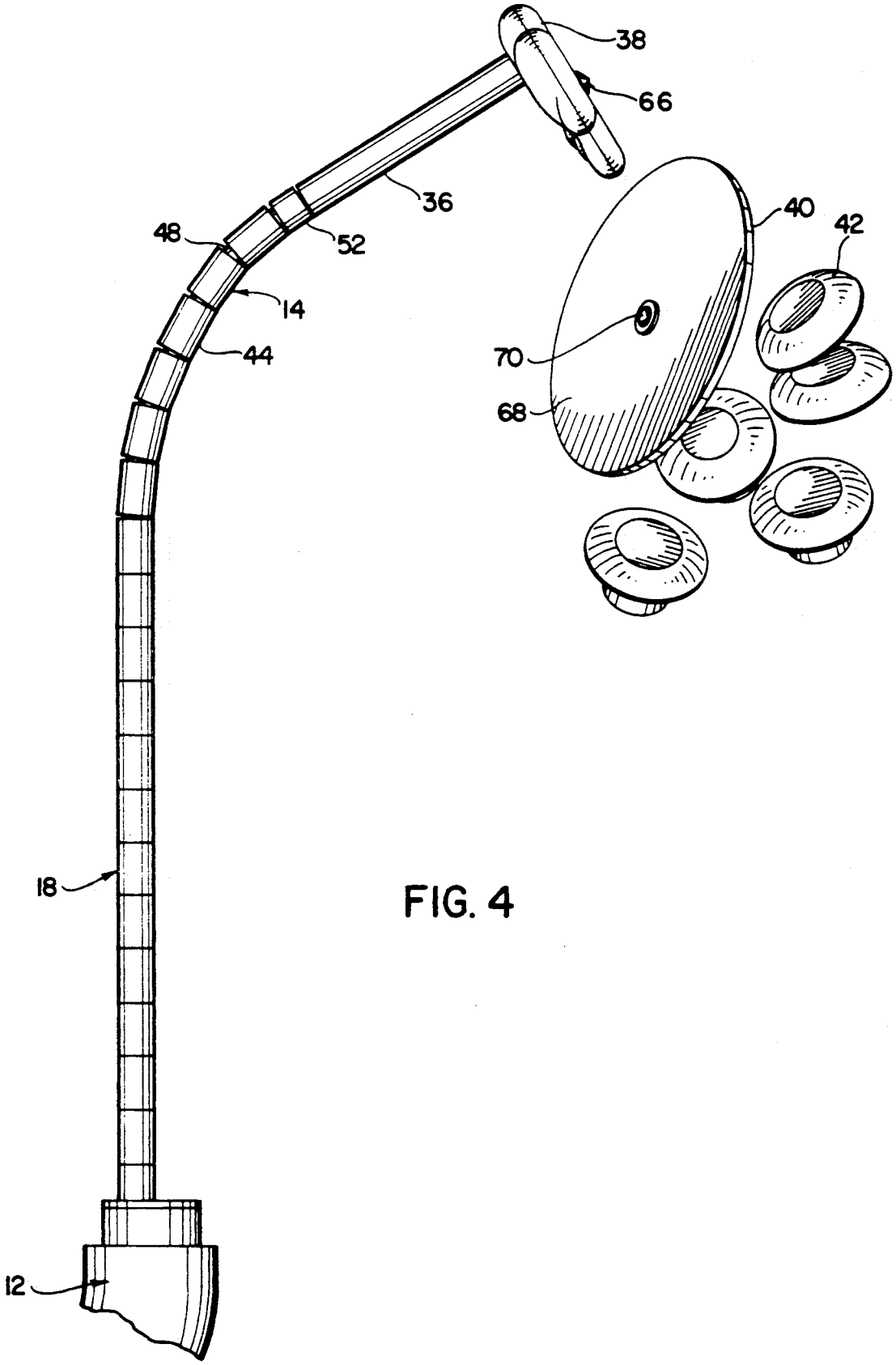
FIG. 4 is a perspective view of the appendage in an extended, collapsed disposition.
Figure 5:
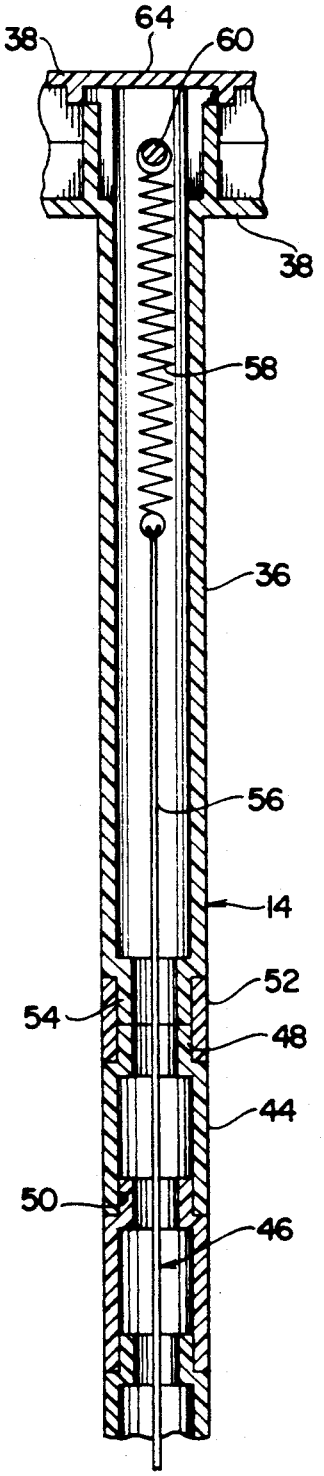
FIG. 5 is a sectional view taken along line 5—5 in FIG. 3.
Figure 6:
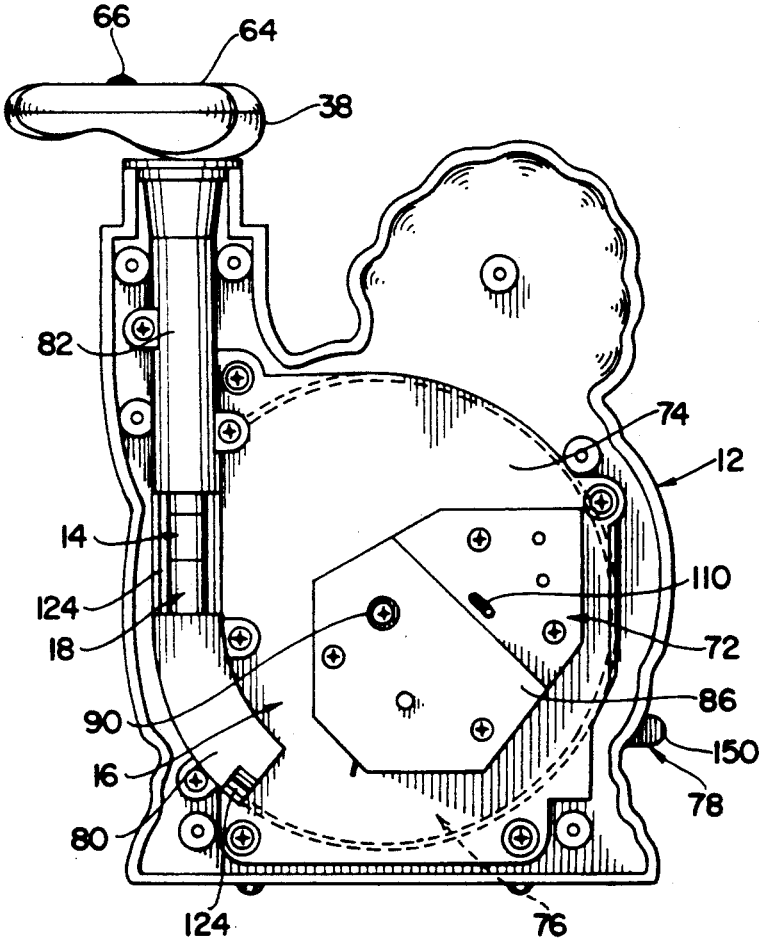
FIG. 6 is a front elevational view of the apparatus with the front section of the body portion removed.
Figure 7:
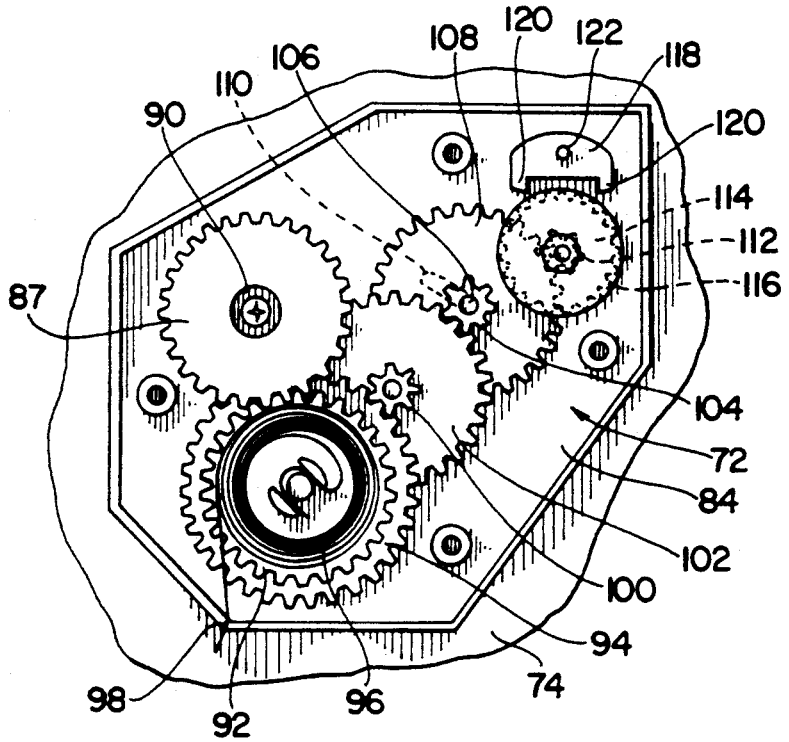
FIG. 7 is a front elevational view of the advancing mechanism with the front portion of the housing thereof removed.

Accordingly, for use and operation of the toy game apparatus 10 the winding knob 88 is rotated to wind the spring 96 as the appendage 14 is retracted into the body portion 12. The elevation mechanism 17 is adjusted to a desired position, and the tray 40 is then assembled on the hand 38. The apparatus 10 is then operable in a game, wherein game players are required to assemble dishes 42 on the tray 40 and/or to operate the actuator mechanism 78 for advancing the appendage 14 upwardly. As game players manipulate the actuator mechanism 78 for advancing the appendage 14 upwardly and/or they assemble dishes 42 on the tray 40 the stability of the appendage 14 is decreased. Finally, when the appendage 14 is advanced upwardly to a point where the weight thereof, including the weight of the dishes 42, causes the arm portion 18 to collapse, the appendage 14 collapses causing the dishes 42 and the tray 40 to fall from the hand 48 as illustrated in FIG. 4.

It is seen therefore that the instant invention provides an effective toy game apparatus. The game apparatus 10 is operative for extending the appendage 14 upwardly from the body portion 12 in an unusual and interesting manner, and it is further operative for balancing the tray 40 and the dishes 42 on the hand 38. The actuator mechanism 78 is effectively operative for controlling the upward advancement of the appendage 14 with the advancing mechanism 16, and the elevation mechanism 17 is effectively operative for altering the stability of the appendage 14 by causing it to be advanced upwardly at a slight angle to vertical. Accordingly, the apparatus 10 can be effectively utilized in an amusing and interesting toy game, and because of its unique and interesting features it can effectively provide children with relatively high levels of amusement over prolonged periods of time. Hence, it is seen that the toy game apparatus of the instant invention represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy game apparatus comprising a character figure body portion adapted to be received in a substantially upright disposition on a supporting surface, a substantially vertically disposed, extendable semi-rigid appendage on said character figure body portion, and manually controllable advancing means for selectively advancing said appendage from a retracted position substantially within said body portion to various different vertically extended positions relative thereto, said appendage being laterally bendable and collapsible in response to the application of a lateral bending force thereto, said appendage also being constructed such that it is vertically extendable to a point where it becomes sufficiently unstable to cause it to laterally collapse under its own weight.

2. In the toy game apparatus of claim 1, said appendage comprising a laterally bendable and collapsible arm on said character figure.

3. In the toy game apparatus of claim 1, said appendage comprising a flexible center core element and a plurality of discrete tubular appendage segments on said core element, said appendage segments being disposed in a sequential order on said core element, wherein adjacent appendage segments are in biased engagement with one another.

4. In the toy game apparatus of claim 3, at least a portion of said appendage segments each having a reduced neck formed at one end thereof and a socket formed at the opposite end thereof, each of said reduced necks being received in a socket of an adjacent appendage segment.

5. In the toy game apparatus of claim 3, said core element comprising a resiliently extendable core element and resiliently biasing adjacent appendage segments into engagement with one another.

6. In the toy game apparatus of claim 1, said advancing means comprising means for coiling said appendage into a substantially circular casing and for dispensing said appendage therefrom in order to advance said appendage upwardly.

7. In the toy game apparatus of claim 1, said appendage having an upper extremity and including platform means at the upper extremity thereof for balancing articles thereon.

8. In the toy game apparatus of claim 1, said advancing means including a spring-loaded release lever for selectively controlling the advancement of said appendage from said body portion.

9. The toy game apparatus of claim 1, further comprising means for tilting said appendage so that it is advanced upwardly at a slight angle to vertical when said body portion is received on a horizontal supporting surface.

10. In the toy game apparatus of claim 9, said means for tilting comprising means for raising one side portion of said body portion above said supporting surface.

11. In the toy game apparatus of claim 6, said casing being manually rotatable in a first direction for coiling said appendage therein and being rotatable in an opposite second direction for dispensing said appendage therefrom.

12. A toy game apparatus comprising a body portion adapted to be received in a substantially upright disposition on a supporting surface, a substantially vertically disposed, extendable semi-rigid appendage, and manually controllable advancing means for selectively advancing said appendage from a retracted position substantially within said body portion to various different vertically extended positions relative thereto, said appendage being laterally bendable and collapsible in response to the application of a lateral bending force thereto, said appendage also being constructed such that it is vertically extendable to a point where it becomes sufficiently unstable to cause it to laterally collapse under its own weight, said appendage comprising a flexible center core element and a plurality of discrete tubular appendage segments on said core element, said appendage segments being disposed in a sequential order on said core element, wherein adjacent appendage segments are in biased engagement with one another.

13. A toy game apparatus comprising a character figure body portion adapted to be received in a substantially upright disposition on a supporting surface, a substantially vertically disposed, extendable semi-rigid appendage, and manually controllable advancing means for selectively advancing said appendage from a retracted position substantially within said body portion to various different upwardly extended positions relative thereto, said appendage being laterally bendable and collapsible in response to the application of a lateral bending force thereto, said appendage also being constructed such that it is vertically extendable to a point where it becomes sufficiently unstable to cause it to laterally collapse under its own weight, said advancing means comprising means for coiling said appendage into a substantially circular casing and for dispensing said appendage therefrom in order to advance said appendage upwardly.

14. A toy game apparatus comprising a body portion adapted to be received in a substantially upright disposition on a supporting surface, a substantially vertically disposed, extendable semi-rigid appendage, and manually controllable advancing means for selectively advancing said appendage from a retracted position substantially within said body portion to various different vertically extended positions relative thereto, said appendage being laterally bendable and collapsible in response to the application of a lateral bending force thereto, said appendage also being constructed such that it is vertically extendable to a point where it becomes sufficiently unstable to cause it to laterally collapse under its own weight, said advancing means including a spring-loaded release lever for selectively controlling the advancement of said appendage from said body portion.

* * * * *